US012643014B2

(12) United States Patent
Shannon et al.

(10) Patent No.: US 12,643,014 B2
(45) Date of Patent: Jun. 2, 2026

(54) NOSE CLIP AND NOSE CLIP AND PLUG STRUCTURES

(71) Applicant: Nose Grips, LLC, Western Springs, IL (US)

(72) Inventors: Liam Michael Shannon, Western Springs, IL (US); Gavin Neill Shannon, Western Springs, IL (US); Peter M. Shannon, III, Western Springs, IL (US); Gary W. Grube, Barrington Hills, IL (US)

(73) Assignee: Nose Grips, LLC, Western Springs, IL (US)

( * ) Notice: Subject to any disclaimer, the term of this patent is extended or adjusted under 35 U.S.C. 154(b) by 532 days.

(21) Appl. No.: 18/214,636

(22) Filed: Jun. 27, 2023

(65) Prior Publication Data

US 2024/0261638 A1 Aug. 8, 2024

Related U.S. Application Data

(60) Provisional application No. 63/443,491, filed on Feb. 6, 2023.

(51) Int. Cl.
*A63B 33/00* (2006.01)

(52) U.S. Cl.
CPC ..... *A63B 33/00* (2013.01)

(58) Field of Classification Search
CPC ..... A61F 2013/0028; A61F 2007/0006; A61F 13/126; A61F 2/186; A63B 33/00; A61B 2018/00327; A61B 1/233; A62B 23/06; A61M 2210/0618; A61M 29/00; A61M 29/02
See application file for complete search history.

(56) References Cited

U.S. PATENT DOCUMENTS

| | | | |
|---|---|---|---|
| 5,103,813 | A | 4/1992 | Hart |
| 5,464,413 | A | 11/1995 | Siska, Jr. |
| 6,561,184 | B2 | 5/2003 | Chiang |
| 8,171,933 | B2 | 5/2012 | Xue |
| 8,365,734 | B1 | 2/2013 | Lehman |
| 8,960,195 | B2 | 2/2015 | Lehman |
| 9,095,674 | B2 | 8/2015 | Toriumi |
| 10,688,324 | B2 | 6/2020 | Chiang |

FOREIGN PATENT DOCUMENTS

| | | | | |
|---|---|---|---|---|
| GB | 2572972 A | * | 10/2019 | ..... A63B 33/00 |
| WO | WO-2015039897 A1 | * | 3/2015 | ..... A63B 33/00 |

* cited by examiner

*Primary Examiner* — Ictoria Murphy
(74) *Attorney, Agent, or Firm* — Gary W. Grube

(57) ABSTRACT

A nose clip structure, to inhibit water from entering a swimmer's nose includes first and second septum pads that include first and second septum contact areas. The nose clip structure further includes a septum clip to exert pressure against the first and second septum pads such that the first and second septum contact areas engage opposite sides of a septum of the swimmer's nose to maintain an operational position of the septum clip. The nose clip structure further includes first and second nose pads that include first and second columella contact areas. The nose clip structure further includes a lower nose clip coupled to the septum clip to exert pressure against the first and second nose pads such that the first and second columella contact areas engage the first and second columella of the swimmer's nose.

6 Claims, 5 Drawing Sheets

NOSE CLIP AND NOSE CLIP AND PLUG STRUCTURES

CROSS-REFERENCE TO RELATED APPLICATIONS

The present U.S. Utility Patent application claims priority pursuant to 35 U.S.C. § 119(e) to U.S. Provisional Application No. 63/443,491, entitled "NOSE CLIP AND NOSE CLIP AND PLUG STRUCTURES" filed Feb. 6, 2023, which is hereby incorporated herein by reference in its entirety and made part of the present U.S. Utility Patent application for all purposes.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

Technical Field of the Invention

This invention relates generally to nose plug and clip and nose clip structures which is adapted to couple to a swimmer's nose in order to limit water exposure within a nose of the swimmer.

Description of Related Art

Swimmers have used nose clips in order to limit exposure of the swimmer's nasal cavity to pool water. The nose clip generally includes a spring structure to hold on to a swimmer's nose with enough force to prevent water entering the nasal cavity but not too much force to be uncomfortable.

Nose clips are generally designed in a U shape so the sides clip on to the swimmer's nose. Nose clips have been made with various cushioning materials to address comfort so that the swimmer is motivated to use the nose clip. For various reasons the nose clips are rarely, if ever, comfortable to the swimmer and work well to exclude unwanted water from entering the nose. Reasons include materials that contact the nose, mismatch of shape of the clip and shape of the nose, clamping force of the clip, and slippage during a swim.

BRIEF DESCRIPTION OF THE SEVERAL VIEWS OF THE DRAWING(S)

DETAILED DESCRIPTION OF THE INVENTION

Figure 1A:
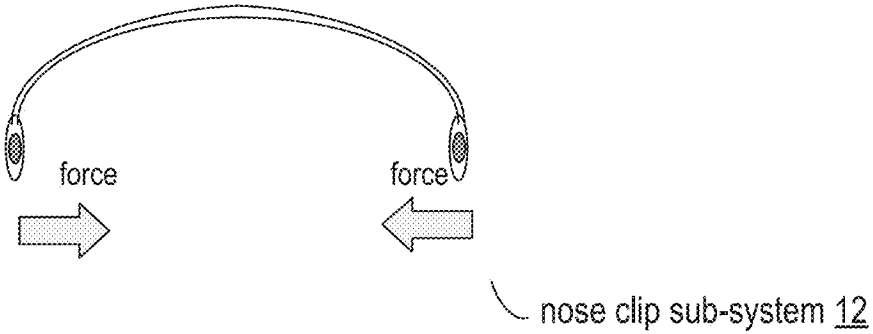
FIG. 1A is an exploded perspective view showing an embodiment of a nose clip sub-system in accordance with the present invention.

FIG. 1A is an exploded perspective view showing an embodiment of a nose clip sub-system 12 of a nose plug and clip structure described in more detail with reference to FIG. 1C. The nose clip sub-system 12 is worn over the top of the nose of the swimmer. The nose clip sub-system 12 provides an inward compression force upon the nose such as to substantially keep the nose clip sub-system 12 firmly attached to the swimmer's nose during usage. The nose clip sub-system 12 further provides a facility to support a nose plug sub system 14 used underneath the nose to provide the plugs for essentially watertight operation while swimming.

Figure 1B:
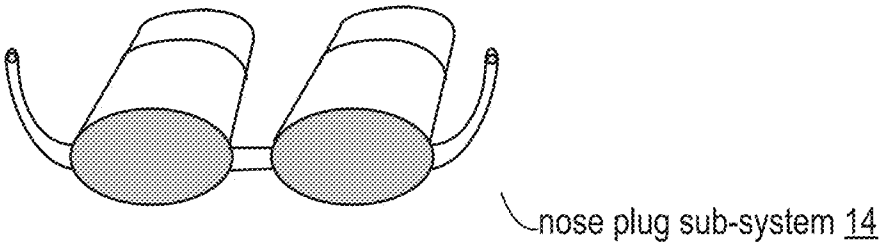
FIG. 1B is an exploded perspective view showing an embodiment of a nose plug sub-system in accordance with the present invention.

FIG. 1B is an exploded perspective view showing an embodiment of a nose plug sub-system described in more detail with reference to FIG. 1C. In an embodiment, nose plug sub-system 14 attaches to the nose clip sub-system 12 providing a form of anchoring such that the nose plug sub-system 14 remains in a desired position under the nose during utilization.

Figure 1C:
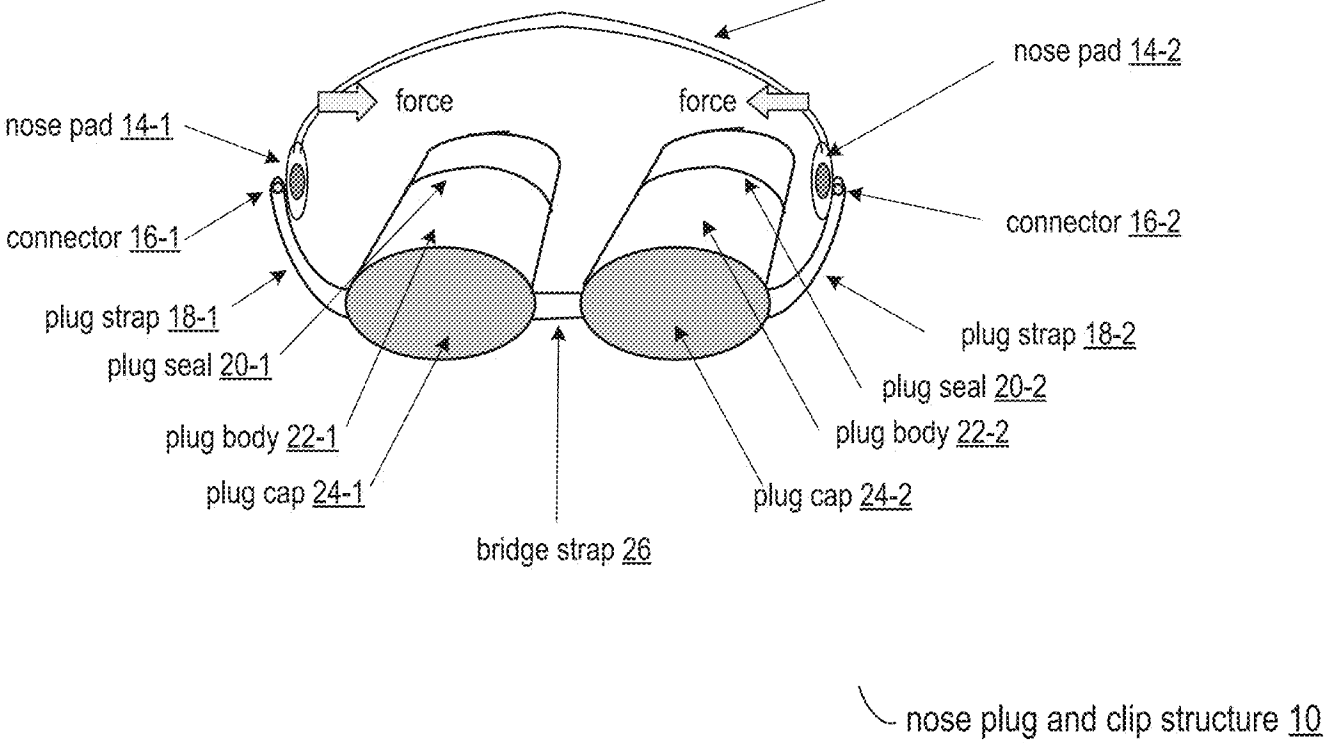
FIG. 1C is an exploded perspective view showing a first embodiment of a nose plug and clip structure in accordance with the present invention.

FIG. 1C is an exploded perspective view showing a first embodiment of the nose plug and clip structure 10 that includes the nose clip sub-system 12 and the nose plug sub-system 14. The nose clip sub-system 12 further includes a nose clip 12 and nose pads 14-1 and 14-2. The nose clip 12 comprises a spring material to provide a clamping force upon the nose as the nose clip 12 is worn over the top of the nose. The nose pads 14-1 and 14-2, contact with the nose to provide a cushioning for comfort and to, in an embodiment, provide an inward force through the nose to a portion of the nose plug sub-system 14 to further keep the nose plug and clip structure 10 in place during utilization.

In an embodiment, a further function of the nose pads 14-1 and 14-2 is to provide connectivity between the nose clip sub-system 12 and the nose plug sub-system 14. For example, the nose pads 14-1 and 14-2 further include a coupler and/or clips, or any other mechanism, to provide coupling between the two sub-systems.

The nose plug sub-system 14 further includes connectors 16-1 and 16-2, plug straps 18-1 and 18-2, and plug bodies 22-1 and 22-2. The plug bodies further include plug caps 24-1 and 24-2, and plug seals 20-1 and 20-2. The nose plug sub-system 14 further includes a bridge strap 26 between the two plug bodies 21-1 and 22-2.

The connectors 16-1 and 16-2 provide physical coupling with the nose pads 14-1 and 14-2 to substantially join the nose clip sub-system 12 and the nose plug sub-system 14. The physical coupling may include a rigid non-movable facility or a pivoting facility to provide some degree of independent movement of the two sub-systems during utilization.

The plug straps 18-1 and 18-2 provide coupling between the plug bodies 21-1 and 21-2 and the connectors 16-1 and 16-2. The plug bodies 22-1 and 22-2 are together inserted into the swimmer's nostrils during utilization and with the aid of the plug seals 20-1 and 20-2, provide the desired function of excluding water from entering the nostrils. For example, the plug seals 20-1 and 20-2 comprise one or more of a set of O-him rings, a set of flaps, and a set of undulations integrated into the plug bodies. The plug caps 24-1 and 24-2 provide endpoints for the two plug bodies to facilitate ease of nostril insertion and removal.

In an embodiment, the plug bodies 21-1 and 21-2 further include small magnets orientated such as to provide attraction between the plug bodies thus providing a higher level of stability to maintain the insertion placement of the plug bodies within the nostrils during utilization. Further, such magnets provide attraction to other magnets further included within the nose pads 14-1 and 14-2 to provide a yet further level of stability of the nose plug and clip structure 10 during operation.

All of the clip, straps, pads and plugs may be manufactured with a waterproof soft material such as rubber, plastic, polyurethane, and silicone-based compounds to provide further waterproofed us and elasticity during operation.

Figure 2:
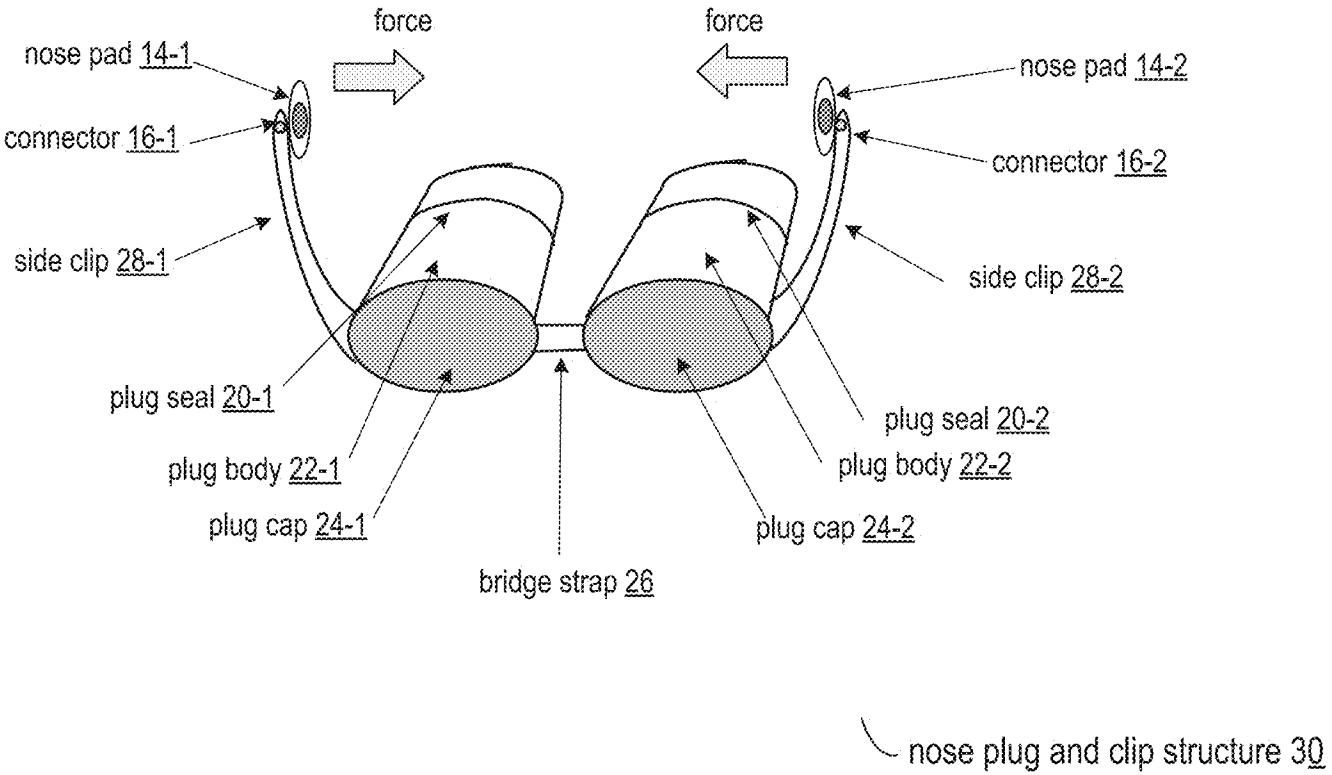
FIG. 2 is an exploded perspective view showing a second embodiment of the nose plug and clip structure in accordance with the present invention.

FIG. 2 is an exploded perspective view showing a second embodiment of a nose plug and clip structure 30. The nose plug and clip structure 30 is worn under the nose of the swimmer. The nose plug and clip structure 30 provides an inward compression force, from underneath the nostrils, upon the nose such as to substantially keep the nose plug and clip structure 30 firmly attached to the swimmer's nose during usage. The nose plug and clip structure 30 further provides a facility to support nose plugs used underneath the nose to provide the plugs for essentially watertight operation while swimming.

In an embodiment, the nose plug and clip structure 30 includes nose pads 14-1 and 14-2. The nose pads 14-1 and 14-2, contact with the nose to provide a cushioning for comfort and to, in an embodiment, provide an inward force through the nose to a portion of the nose plug and clip structure 30 to further keep the structure in place during utilization.

The nose pads 14-1 and 14-2 couple to side clips 28-1 and 28-2. The side clips 28-1 and 28-2 comprises a spring material to provide a clamping force upon the nose as the nose plug and clip structure 30 is worn under the bottom of the nose.

In an embodiment, a further function of the nose pads 14-1 and 14-2 is to provide connectivity between the nose pads and the side clips, via connectors 16-1 and 16-2. For example, the nose pads 14-1 and 14-2 further include a coupler and/or clips, or any other mechanism, to provide coupling between the nose pads and the connectors of the side clips.

The nose plug and clip structure 30 further includes connectors 16-1 and 16-2, plug the side clips 28-1 and 28-2, and plug bodies 22-1 and 22-2. The plug bodies further include plug caps 24-1 and 24-2, and plug seals 20-1 and 20-2. The nose plug and clip structure 30 further includes a bridge strap 26 between the two plug bodies 21-1 and 22-2.

The connectors 16-1 and 16-2 further provide physical coupling with the nose pads 14-1 and 14-2 to substantially join the side clips 28-1 and 28-2 and the nose pads 14-1 and 14-2. The physical coupling may include a rigid non-movable facility or a pivoting facility to provide some degree of independent movement of the structure.

The side clips 28-1 and 28-2 provide coupling between the plug bodies 21-1 and 21-2 and the connectors 16-1 and 16-2. The plug bodies 22-1 and 22-2 are together inserted into the swimmer's nostrils during utilization and with the aid of the plug seals 20-1 and 20-2, provide the desired function of excluding water from entering the nostrils. The plug caps 24-1 and 24-2 provide endpoints for the two plug bodies to facilitate ease of nostril insertion and removal.

In an embodiment, the plug bodies 21-1 and 21-2 further include small magnets orientated such as to provide attraction between the plug bodies thus providing a higher level of stability to maintain the insertion placement of the plug bodies within the nostrils during utilization. Further, such magnets provide attraction to other magnets further included within the nose pads 14-1 and 14-2 to provide a yet further level of stability of the nose plug and clip structure 30 during operation.

All of the clip, straps, pads and plugs may be manufactured with a waterproof soft material such as rubber, plastic, polyurethane, and silicone-based compounds to provide further waterproofed us and elasticity during operation.

Figure 3A:
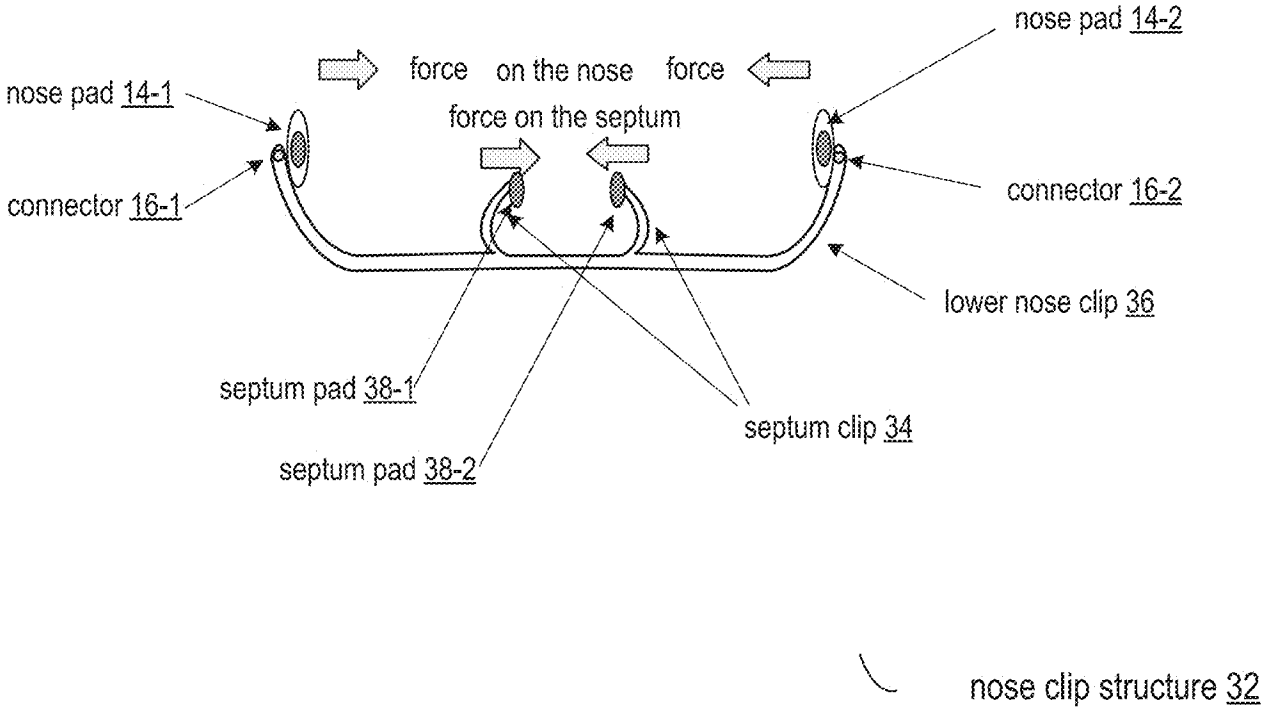
FIG. 3A is an exploded perspective view showing another embodiment of a nose clip structure in accordance with the present invention.

FIG. 3A is an exploded perspective view showing another embodiment of a nose clip structure. The nose clip structure 32 is worn under the nose of the swimmer. The nose clip structure 32 provides an inward compression force from below the nostrils such as to substantially keep the nose clip structure 32 firmly attached to the swimmer's nose and pinching the nostrils to shut out water during usage.

In an embodiment, the nose clip structure 32 includes nose pads 14-1 and 14-2. The nose pads 14-1 and 14-2 contact with first and second (e.g., left and right) columellas of the nose via first and second columella contact areas to provide a cushioning for comfort and to, in an embodiment, provide an inward pinching force upon the nose to further keep the structure in place and shutting out water during utilization.

The nose pads 14-1 and 14-2 couple to a lower nose clip 36. In an embodiment, the lower nose clip 36 comprises a spring material to provide a clamping force upon the nose as the nose clip structure 32 is utilized. The lower nose clip is configured to exert pressure against the first nose pad and the second nose pad such that the first columella contact area engages the first columella of the swimmer's nose and the second columella contact area engages the second columella of the swimmer's nose to inhibit water from entering the swimmer's nose.

In an embodiment, a further function of the nose pads 14-1 and 14-2 is to provide connectivity between the nose pads, via, when used, connectors 16-1 and 16-2, For example, the nose pads 14-1 and 14-2 further include a coupler and/or clips, or any other mechanism, to provide coupling between the nose pads and the connectors of the side clips.

The connectors 16-1 and 16-2 further provide physical coupling with the nose pads 14-1 and 14-2 to substantially join the lower nose clip 36 and the nose pads 14-1 and 14-2. The physical coupling may include a rigid non-movable facility or a pivoting facility to provide some degree of independent movement of the structure.

The lower nose clip 36 provides coupling between the nose pads 14-1 and 14-2 and, in an embodiment, provides a compression force on the nose to pinch the nostrils closed to keep out water. The lower nose clip is further configured to couple to a septum clip 34. The septum clip 34 is inserted into the swimmer's nostrils during utilization and pinches the septum to facilitate keeping the nose clip structure 32 in contact with the swimmer's nose during utilization to maintain an operational position of the septum clip in relation to the swimmer's nose.

All of the clip and pads may be manufactured with a waterproof soft material such as rubber, plastic, polyurethane, and silicone-based compounds to provide further waterproofed us and elasticity during operation.

Figure 3B:
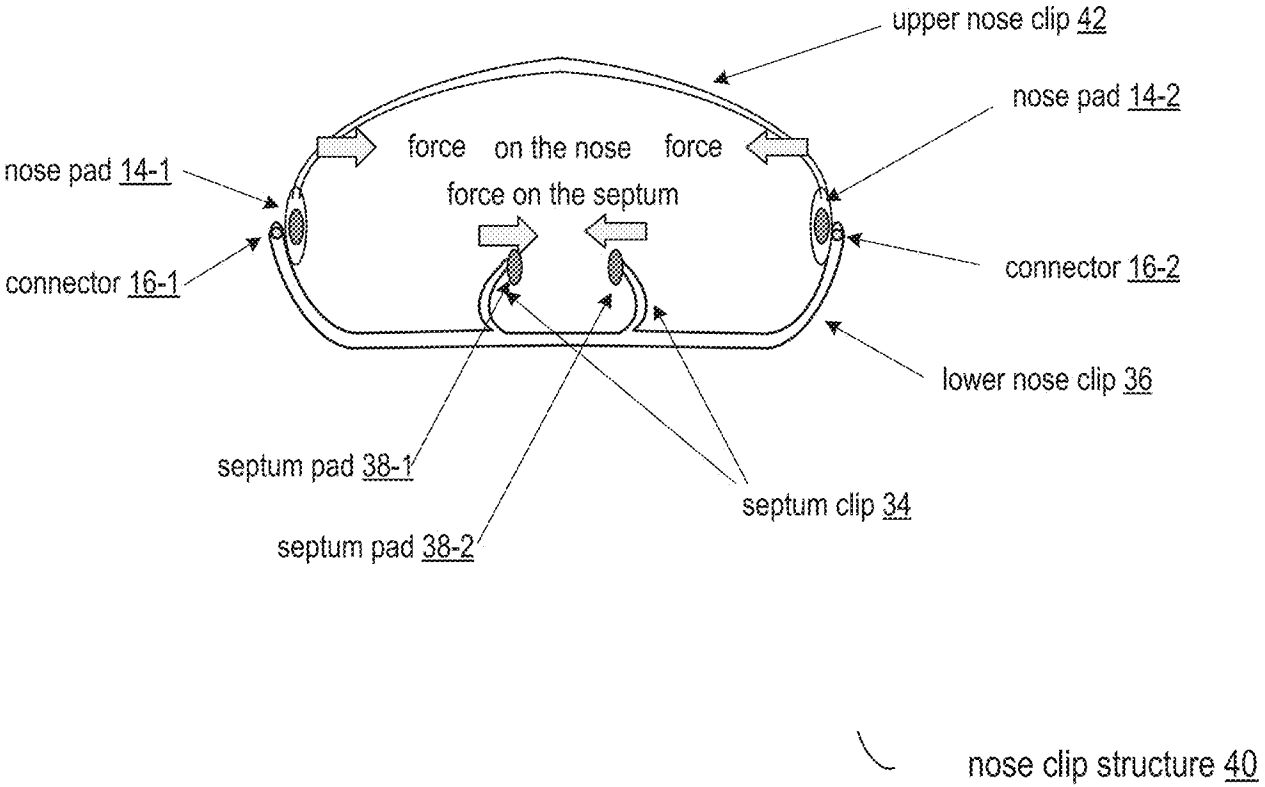
FIG. 3B is an exploded perspective view showing another embodiment of a nose clip structure in accordance with the present invention.

FIG. 3B is an exploded perspective view showing another embodiment of a nose clip structure 40. The nose clip structure 40 is worn under and over the nose of the swimmer. The nose clip structure 40 provides an inward compression force, from above the nostrils, and in an embodiment, from below the nostrils too such as to substantially keep the nose clip structure 40 firmly attached to the swimmer's nose during usage.

In an embodiment, the nose clip structure 32 includes nose pads 14-1 and 14-2. The nose pads 14-1 and 14-2 contact with the nose to provide a cushioning for comfort and to, in an embodiment, provide an inward pinching force upon the nose to further keep the structure in place and shutting out water during utilization. An upper nose clip 42 couples the nose pads 14-1 and 14-2 and provides a compression force upon the nose via the nose pads 14-1 and 14-2. The upper nose clip is configured to exert further pressure against the first nose pad and the second nose pad such that the first columella contact area further engages the first columella of the swimmer's nose and the second columella contact area further engages the second columella of the swimmer's nose to further inhibit the water from entering the swimmer's nose.

The nose pads 14-1 and 14-2 further couple to a lower nose clip 36. In an embodiment, the lower nose clip 36 comprises a spring material to provide a further clamping force upon the nose as the nose clip structure 40 is utilized.

In an embodiment, a further function of the nose pads 14-1 and 14-2 is to provide connectivity between the nose pads, via, when used, connectors 16-1 and 16-2. For example, the nose pads 14-1 and 14-2 further include a coupler and/or clips, or any other mechanism, to provide coupling between the nose pads and the connectors of the side clips.

The connectors 16-1 and 16-2 further provide physical coupling with the nose pads 14-1 and 14-2 to substantially join the lower nose clip 36 and the nose pads 14-1 and 14-2. The physical coupling may include a rigid non-movable facility or a pivoting facility to provide some degree of independent movement of the structure.

The lower nose clip 36 provides coupling between the nose pads 14-1 and 14-2 and, in an embodiment, provides a compression force on the nose to pinch the nostrils closed to keep out water. The lower nose clip is further configured to couple to a septum clip 34. The septum clip 34 is inserted into the swimmer's nostrils during utilization and pinches the septum to facilitate keeping the nose clip structure 32 in contact with the swimmer's nose during utilization.

The lower nose clip is configured to exert the pressure against the first nose pad and the second nose pad such that the first columella contact area engages the first columella of the swimmer's nose and the second columella contact area engages the second columella of the swimmer's nose to compress the first columella of the swimmer's nose against the septum of the swimmer's nose to inhibit the water from entering a first nostril of the swimmer's nose without interfering with the engaging of the first septum contact area with the septum of the swimmer's nose and to compress the second columella of the swimmer's nose against the septum of the swimmer's nose to inhibit the water from entering a second nostril of the swimmer's nose without interfering with the engaging of the second septum contact area with the septum of the swimmer's nose.

All of the clip and pads may be manufactured with a waterproof soft material such as rubber, plastic, polyurethane, and silicone-based compounds to provide further waterproofed us and elasticity during operation.

The one or more embodiments are used herein to illustrate one or more aspects, one or more features, one or more concepts, and/or one or more examples and are not to be restrictive. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While particular combinations of various functions and features of the one or more embodiments have been expressly described herein, other combinations of these features and functions are likewise possible. The present disclosure is not limited by the particular examples disclosed herein and expressly incorporates these other combinations.

What is claimed is:

1. A nose clip structure, adapted to fit a swimmer's nose, comprising:

a first septum pad that includes a first septum contact area;

a second septum pad that includes a second septum contact area, wherein the first septum pad and the second septum pad are configured such that the first septum contact area and the second septum contact area engage opposite sides of a septum of the swimmer's nose;

a septum clip, the septum clip configured to exert pressure against the first septum pad and the second septum pad such that the first septum contact area and the second septum contact area engage the opposite sides of the septum of the swimmer's nose to maintain an operational position of the septum clip in relation to the swimmer's nose;

a first nose pad that includes a first columella contact area;

a second nose pad that includes a second columella contact area, wherein the first nose pad and the second nose pad are configured such that the first columella contact area engages a first columella of the swimmer's nose and the second columella contact area engages a second columella of the swimmer's nose;

a lower nose clip coupled to the septum clip to maintain an operational position of the lower nose clip in relation to the swimmer's nose, the lower nose clip configured to exert pressure against the first nose pad and the second nose pad such that the first columella contact area engages the first columella of the swimmer's nose and the second columella contact area engages the second columella of the swimmer's nose to inhibit water from entering the swimmer's nose; and an upper nose clip coupled to the first nose pad and the second nose pad, the upper nose clip configured to exert further pressure against the first nose pad and the second nose pad such that the first columella contact area further engages the first columella of the swimmer's nose and the second columella contact area further engages the second columella of the swimmer's nose to further inhibit the water from entering the swimmer's nose.

2. The nose clip structure of claim 1, wherein the septum clip further comprises:

a spring material to provide a clamping force upon the septum of the swimmer's nose as the nose clip structure is utilized.

3. The nose clip structure of claim 1, wherein the lower nose clip further comprises:

a spring material to provide a clamping force upon the swimmer's nose as the nose clip structure is utilized.

4. The nose clip structure of claim 1, wherein the lower nose clip further comprises:

the lower nose clip configured to exert the pressure against the first nose pad and the second nose pad such that the first columella contact area engages the first columella of the swimmer's nose and the second columella contact area engages the second columella of the swimmer's nose to compress the first columella of the swimmer's nose against the septum of the swimmer's nose to inhibit the water from entering a first nostril of the swimmer's nose and to compress the second columella of the swimmer's nose against the septum of the swimmer's nose to inhibit the water from entering a second nostril of the swimmer's nose.

5. The nose clip structure of claim 1, wherein the lower nose clip further comprises:

the lower nose clip configured to exert the pressure against the first nose pad and the second nose pad such that the first columella contact area engages the first columella of the swimmer's nose and the second columella contact area engages the second columella of the swimmer's nose to compress the first columella of the swimmer's nose against the septum of the swimmer's nose to inhibit the water from entering a first nostril of the swimmer's nose without interfering with the engaging of the first septum contact area with the septum of the swimmer's nose and to compress the second columella of the swimmer's nose against the septum of the swimmer's nose to inhibit the water from entering a second nostril of the swimmer's nose without interfering with the engaging of the second septum contact area with the septum of the swimmer's nose.

6. The nose clip structure of claim 1, wherein the nose clip structure further comprises:

the first septum pad and the second septum pad are constructed utilizing one or more materials including rubber, plastic, polyurethane, and silicone-based compounds;

the septum clip and the lower nose clip are constructed utilizing one or more materials including the rubber, the plastic, the polyurethane, and the silicone-based compounds; and the first nose pad and the second nose pad are constructed utilizing one or more materials including the rubber, the plastic, the polyurethane, and the silicone-based compounds.

* * * * *